US005814949A

United States Patent [19]

Zanardo et al.

[11] Patent Number: 5,814,949

[45] Date of Patent: Sep. 29, 1998

[54] AUTOMATIC PULSE GENERATOR CUTTOFF WITH CAPACITORS CONNECTED ON BOTH SIDES OF THE PRIMARY WINDING OF THE TRIGGER TRANSFORMER

[75] Inventors: Giuseppe Zanardo; Luciano Zanardo, both of Verona, Italy

[73] Assignee: Photo Electronics Snc di Zanardo Giuseppe & C., Verona, Italy

[21] Appl. No.: 933,941

[22] Filed: Sep. 19, 1997

Related U.S. Application Data

[63] Continuation of Ser. No. 524,923, Sep. 8, 1995, abandoned.

[30] Foreign Application Priority Data

Sep. 14, 1994 [IT] Italy ..... VR940055 U

[51] Int. Cl.[6] ..... H05B 41/14

[52] U.S. Cl. ..... 315/289; 315/276; 315/244

[58] Field of Search ..... 315/289, 290, 315/276, 244

[56] References Cited

U.S. PATENT DOCUMENTS

| | | | |
|---|---|---|---|
| Re. 31,486 | 1/1984 | Helmuth | 315/289 |
| 3,944,876 | 3/1976 | Helmuth | 315/289 |
| 4,238,711 | 12/1980 | Wallot | 315/289 |
| 4,323,824 | 4/1982 | Roche et al. | 315/289 |
| 4,461,982 | 7/1984 | Fahnrich | 315/290 |
| 5,084,655 | 1/1992 | Van Zanten | 315/290 |

FOREIGN PATENT DOCUMENTS

| | | |
|---|---|---|
| 0318613 | 6/1989 | European Pat. Off. . |
| 0405715 | 9/1991 | European Pat. Off. . |
| 3929029 | 3/1991 | Germany . |
| 2060287 | 4/1981 | United Kingdom . |
| 2203302 | 10/1988 | United Kingdom . |
| 2273001 | 6/1994 | United Kingdom . |

*Primary Examiner*—Robert Pascal
*Assistant Examiner*—Michael Shingleton
*Attorney, Agent, or Firm*—Guido Modiano; Albert Josif

[57] ABSTRACT

A device for the lighting and instantaneous hot-relighting of lamps of the discharge type, including: a transformer having a first winding and a second winding; a discharge lamp, in which a first electrode is connected to the second winding; one or more capacitive means, which are series-connected to the first winding; and trigger means adapted to trigger, by means of pulses, discharge control means that are connected thereto; the discharge control means produce the discharge of the one or more capacitive means on the first winding, which induces on the second winding a high voltage for the hot-lighting of the discharge lamp.

13 Claims, 2 Drawing Sheets

AUTOMATIC PULSE GENERATOR CUTTOFF WITH CAPACITORS CONNECTED ON BOTH SIDES OF THE PRIMARY WINDING OF THE TRIGGER TRANSFORMER

This is a continuation of application Ser. No. 08/524,923, filed on Sep. 8, 1995, now abandoned.

BACKGROUND OF THE INVENTION

The present invention relates to a device for the lighting and instantaneous hot-relighting of lamps, particularly of the discharge type.

It is known that a discharge lamp using mercury vapors, sodium, or mixtures with metallic halides must reach a certain pressure, after lighting, before it can deliver maximum brightness, and this occurs over a certain time interval (approximately three minutes).

If mains power is interrupted, the lamp switches off and cannot be switched on again immediately when power is restored; it takes approximately ten minutes for the lamp to cool and then reach the operating pressure to obtain maximum brightness.

This is a serious drawback if discharge lamps are used in public places such as sports facilities, airports, and the like, where a delay in relighting can entail dangers.

Furthermore, in some cases the use of lamps is time-controlled by means of tokens, and therefore there is the drawback that after a first automatic switching-off the subsequent user must wait approximately ten minutes to relight the lamp.

The solutions adopted so far to avoid this delay for the relighting of a discharge lamp have entailed the drawbacks of being bulky and most of all considerably expensive, much more than the discharge lamp itself, thus preventing their use.

Cold-lighting a discharge lamp in fact requires approximately 4 kV, which are provided by means of a conventional commercial starter, whereas hot-lighting requires a much higher voltage obtainable exclusively with large and expensive devices.

SUMMARY OF THE INVENTION

A principal aim of the present invention is therefore to provide a device for the lighting and instantaneous hot-relighting of lamps, particularly of the discharge type.

Within the scope of this aim, an object of the present invention is to provide a device for the lighting and relighting of lamps that allows to hot-relight a lamp with the maximum possible brightness.

Another object of the present invention is to provide a device for the lighting and instantaneous hot-relighting of lamps having limited dimensions.

Another object of the present invention is to provide a device for the lighting and instantaneous hot-relighting of lamps having a low cost.

Another object of the present invention is to provide a discharge lamp that is modified to adapt to hot-lighting requirements so as to be compatible with the device according to the present invention.

Another object of the present invention is to provide a lamp holder adapted for socket lamps in accordance with the device according to the invention.

Another object of the present invention is to provide a device for the lighting and hot-relighting of lamps that is highly reliable, and relatively easy to manufacture at competitive costs.

This aim, these objects, and others which will become apparent hereinafter are achieved by a device for the lighting and instantaneous hot-relighting of lamps of the discharge type, characterized in that it comprises: a transformer having a first and a second windings; a discharge lamp, in which a first electrode is connected to said second winding; one or more capacitive means, which are series-connected to said first winding; and trigger means adapted to trigger, by means of pulses, discharge control means connected thereto; said discharge control means producing the discharge of said one or more capacitive means on said first winding, said first winding inducing, on said second winding, a high voltage for the hot-lighting of said discharge lamp.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
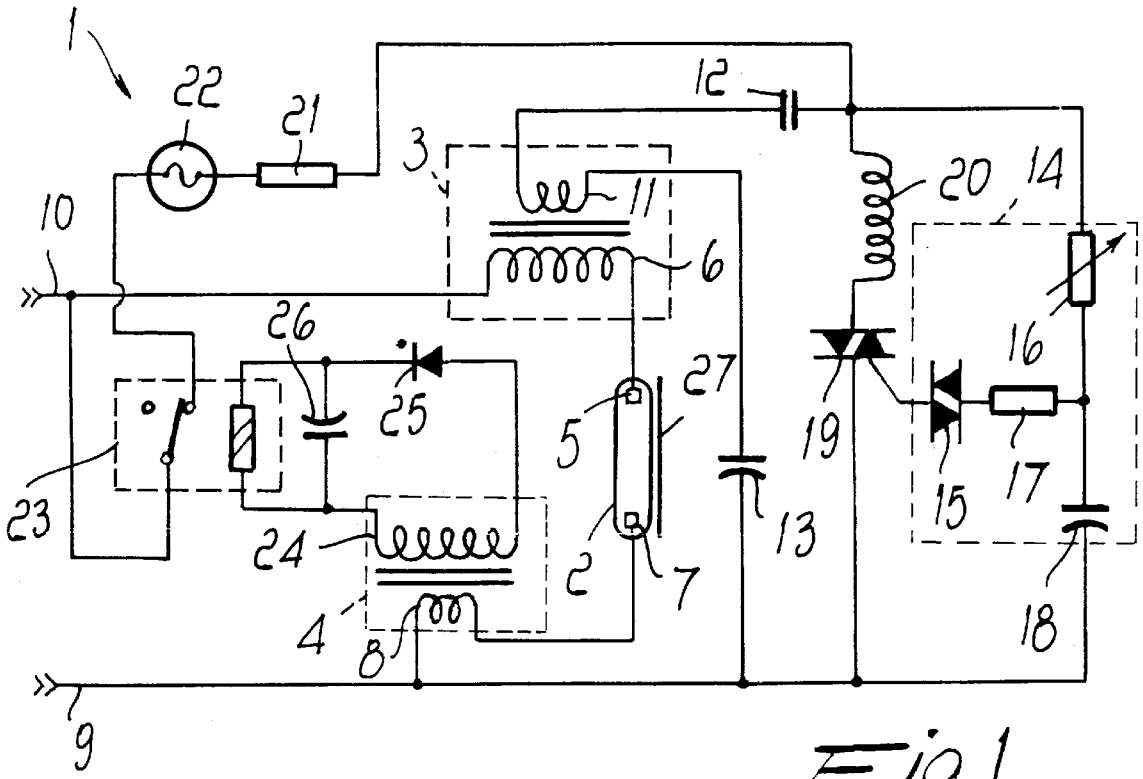
FIG. 1 is a circuit diagram of the device according to the invention.

With reference to FIG. 1, the device according to the invention, generally designated by the reference numeral 1, comprises a lamp 2 of the discharge type connected between a first transformer 3 and a second transformer 4. The first discharge electrode 5 of the lamp 2 (hot-side electrode) is connected to a winding 6 (second winding) of the first transformer 3, and the second discharge electrode 7 of the lamp 2 (cold-side electrode) is connected to a first winding 8 of the second transformer 4.

The second winding 6 of the first transformer 3 and the first winding 8 of the second transformer 4 are connected respectively to a first terminal 9 and to a second terminal 10, to which the alternating supply voltage is applied.

First and second capacitive means, advantageously constituted by two capacitors 12 and 13, are series-connected to the terminals of the first winding 11 of the first transformer 3.

The first capacitor 12 is series-connected to trigger means 14, whereas the second capacitor 13 is connected to the supply terminal 9.

The trigger means 14 are appropriately constituted by a diac 15, a variable resistor 16, a resistor 17, and a capacitor 18, and are connected to discharge control means comprising a triac 19 interposed between the power supply terminal 10 and the power supply terminal 9.

Inductive means 20, conveniently constituted by a coil, limiter means 21, connected in series to the coil 20 and advantageously constituted by a limiting resistor, and adjustment means 22, conveniently comprising a manual-reset thermostat, are interposed between the triac 19 and the power supply terminal 9.

The thermostat 22 is in turn connected to switching means 23 comprising a relay, the normally-closed contacts whereof (as shown in FIG. 1) allow to supply power to the trigger means 14.

The second winding 24 of the second transformer 4 is connected to delay means adapted to delay the opening switching of the relay 23.

Said delay means advantageously comprise a diode 25 that is parallel-connected to a high-capacity electrolytic capacitor 26.

The second winding 6 of the first transformer 3 has a greater number of turns than the first winding 11 of the same transformer, whereas the first winding 8 of the second transformer 4 has a smaller number of turns than the second winding 24 of the same transformer.

Figure 2:
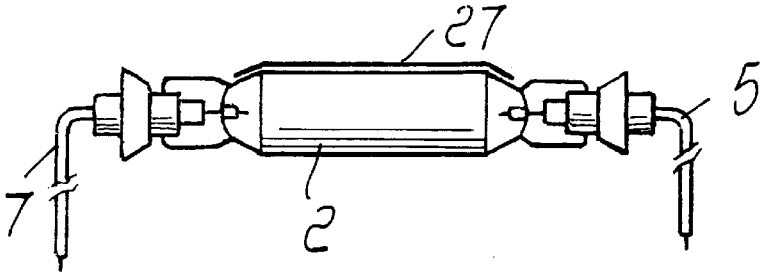
FIG. 2 is a view of a lamp of the discharge type, modified for use with the device according to the invention.

FIG. 2 is a view of the discharge lamp 2 with the respective discharge electrodes 5 and 7 and a wire 27 (also shown in FIG. 1) that is located outside the lamp 2 and is adapted to facilitate the starting of the lamp 2.

Figure 3A:
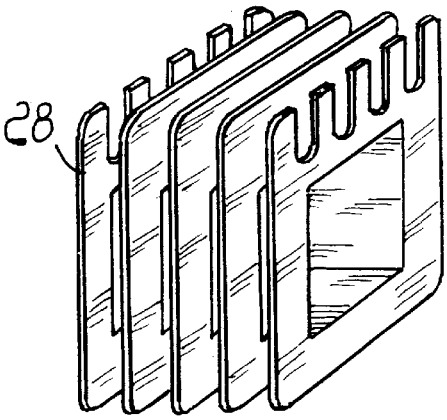
FIG. 3*a* is a perspective view of a bobbin on which windings are formed for use in the device according to the invention.

FIG. 3*a* is a view of a bobbin 28 with a plurality of sections, on which the windings 6 and 11 of the first transformer 3 are formed.

Figure 3B:
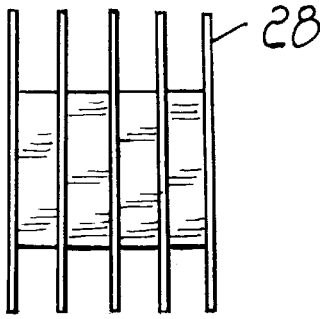
FIG. 3*b* is a side view of the bobbin shown in FIG. 3*a;*
Figure 3C:
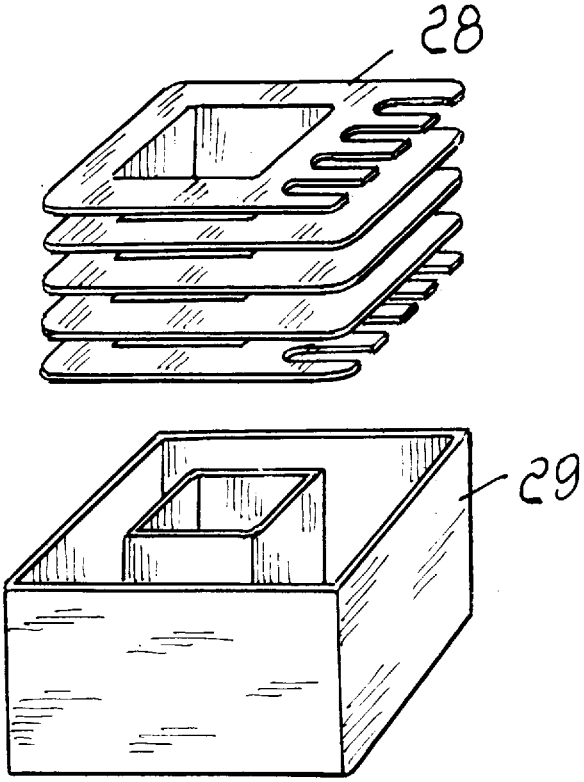
FIG. 3*c* is a perspective view of the insertion of the bobbin of FIG. 3*a* in an appropriate container.

FIG. 3*b* is a side view of the bobbin 28 of FIG. 3*a*, whereas FIG. 3*c* is a view of the insertion of the bobbin 28 in a container 29 for forming the first transformer 3. The container 29 is conveniently made of plastics and is filled with quick-curing resins.

Figure 4:
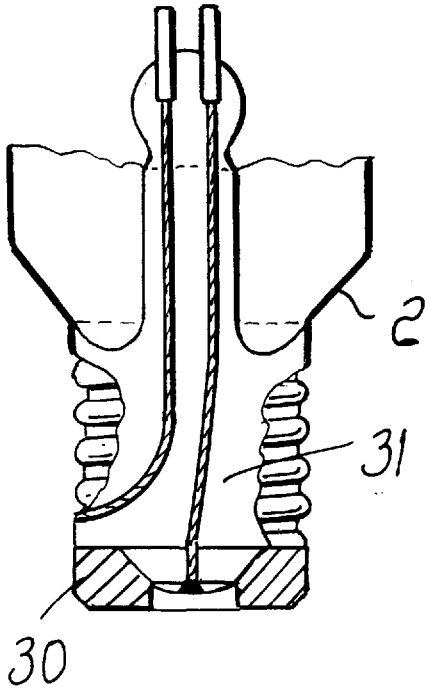
FIG. 4 is a view of a lamp of the discharge type, modified for use with the device according to the invention.

FIG. 4 is a view of a discharge lamp 2 of the type with a standard threaded socket, modified by adding a ring 30 of highly insulating material to adapt it for use of the circuit shown in FIG. 1.

FIG. 4 shows an interspace, designated by the reference numeral 31, that is filled with heat-resistant plastics and from which the wires directed to the socket protrude.

Figure 5:
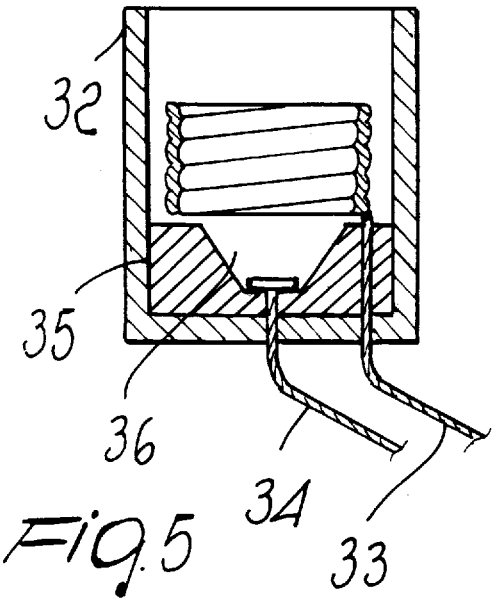
FIG. 5 is a sectional view of a lamp holder for socket lamps, modified for use with the device according to the invention.

FIG. 5 is instead a view of a lamp holder 32 for discharge lamps of the threaded socket type (shown in FIG. 4).

The reference numeral 33 designates the contact of the threaded ring (cold-side contact, corresponding to 7 in FIG. 1), and the reference numeral 34 designates the central contact of the lamp 2 (hot side, corresponding to 5 in FIG. 1).

Figure 6:
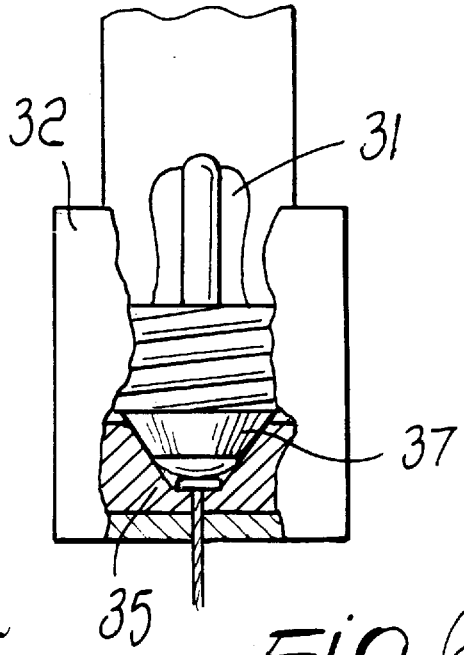
FIG. 6 is a view of the insertion of a socket lamp in the lamp holder shown in FIG. 5.

The reference numeral 35 designates an elastic heat-resistant insulating compound, for example a silicone compound, that covers the bottom of the lamp holder 32, forming a recess 36 (see FIG. 6) that provides the seat for the socket 37 of the lamp 2. In this case, the insulating ring 30 is eliminated, since it is replaced with the insulating compound 35.

With reference to the above figures, the operation of the device according to the invention is as follows.

The alternating supply voltage is applied to the terminals 9 and 10 of the circuit shown in FIG. 1.

The second winding 6 of the first transformer 3 acts as a ballast, with the purpose of limiting the current of the lamp 2 with its discharge electrodes 5 and 7.

The wire 27 located outside the lamp 2 has the purpose of facilitating the lighting of said lamp.

The trigger means 14 trigger the triac 19 by means of pulses; in this manner, every time the triac 19 is triggered, the capacitors 12 and 13 discharge onto the first winding 11 of the first transformer 3; said capacitors are kept constantly charged by the limiting resistor 21. The capacitor 12 has the purpose of considerably increasing the discharge on the winding 11.

The voltage of the capacitors 12 and 13, discharged by pulses by means of the triac 19 on the winding 11, induces a very high voltage in the second winding 6 (the number of turns whereof is greater than that of the winding 11).

Normally, approximately 4 kV, obtained with a conventional commercial starter, are required to cold-light a discharge lamp. In the circuit according to the invention, by virtue of the (high-voltage) ballast-transformer 3 composed of the windings 6 and 11, a voltage of approximately 30 kV is obtained that allows hot-lighting under pressure of the lamp 2, avoiding forced pauses.

The coil 20 has the purpose of protecting the triac 19, whereas the reference numeral 16 designates a variable resistor that allows to give the trigger pulse to the lamp 2 in the correct point of the alternating sinusoid of the lamp power supply. The lamp lights more easily if the trigger pulse precedes the positive and negative cusps of the sine curve, since the triac 19 acts on each period of the sine curve.

Said resistor 16 is adjusted according to the type of lamp 2 in order to achieve the best possible hot-lighting.

Since the trigger voltage at the lamp 2 is required only for a few moments, a second transformer 4 is arranged in series to the lamp 2 in order to automatically interrupt the trigger voltage (which is very high, approximately 30 kV) as soon as the lamp has lighted.

When the lamp 2 has been started, alternating current flows in the winding 8 and induces on the winding 24 a voltage adapted to drive the relay 23.

The diode 25 and the high-capacity electrolytic capacitor 26 have the purpose of delaying the attraction of the relay 23, which supplies, by means of its normally-closed contacts (as shown in FIG. 1), the trigger circuit formed by the trigger means 14 and by the triac 19.

This delay allows to give a certain duration to the trigger pulses and ensures the lighting of the lamp 2.

The manual-reset thermostat 22 has a safety function, since it interrupts the trigger circuit when the lamp 2 does not work due to aging or to possible malfunction thereof.

Therefore, the trigger pulses occur until the limiting resistor 21, by overheating, trips the thermostat 22 that is series-connected thereto.

After replacing the malfunctioning lamp 2, the thermostat 22 is reset manually to restore the trigger circuit.

FIG. 2 illustrates the modification of the lamp 2 for adaptation to hot-relighting requirements. This modification consists in adding the wire 27 to improve lighting of the lamp 2.

This solution is used for high-power lamps in which the distance between the discharge electrodes 5 and 7 is considerable. If low-power lamps (normally up to 400 W) are used, the wire 27 is not necessary, since the distance between the discharge electrodes 5 and 7 is much smaller and the high lighting voltage is sufficient.

The transformer 3 of FIG. 1 is formed by means of the bobbin 28, on which the windings 6 and 11 are formed; said bobbin is inserted in the container 29 made of plastics. The container is then filled with quick-curing resins that allow to obtain a single high-insulation block that is insensitive to humidity.

Ordinary commercially available discharge lamps, of the type with a standard threaded socket, are designed to operate at medium voltage and are therefore not adapted when the voltages involved are very high, as occurs with the device according to the invention. These sockets are not adapted because they discharge between the two electrodes of the lamp.

In order to eliminate this drawback, the ring 30 is added; said ring is made for example of ceramic material or of another material providing high electrical and thermal insulation. Said ring 30 considerably increases insulation, allowing high-voltage starting of the lamp 2.

Furthermore, the interspace 31 of the lamp 2 where the wires leading to the socket protrude is filled with heat-resistant plastic material, for example resins, silicone products, and the like.

Therefore, with these solutions, a conventional lamp, adapted exclusively for lighting pulses of a few kV, is converted into a lamp adapted for hot-lighting, where it is necessary to apply a very high lighting voltage.

FIG. 5 shows a lamp holder 32 for lamps of the above described socket type. In this case, the lamp holder is modified by adding an elastic heat-resistant insulating compound 35 that covers the bottom of the lamp holder.

In this manner, by screwing the lamp 2 in the lamp holder 32, the elastic insulating compound 35 increases the insulation, since between the electrodes 33 and 34, which correspond respectively to the electrodes 7 and 5 of FIG. 1, there is an insulation of approximately 20 kV-mm, which corresponds to the value of the insulating compound 35, instead of air (which provides an insulation of 1 kV-mm).

In this case, the ring 30 shown in FIG. 4 is replaced with said insulating compound 35.

In practice it has been observed that the device according to the invention fully achieves the intended aim, since it allows to light and instantaneously hot-relight a lamp of the discharge type, avoiding the delays arising from the need to wait for said lamp to cool before subsequent re-lighting.

Furthermore, the device according to the invention is compact and very convenient.

The device thus conceived is susceptible of numerous modifications and variations, all of which are within the scope of the inventive concept.

For example, in applications using high-pressure sodium lamps, which are normally easier to hot-light, a self-starting element (so-called SIDAC, or in-gas dischargers) is used instead of the triac 19 and of the corresponding trigger means 14 in order to simplify the circuit according to the invention.

Furthermore, instead of the thermostat 22 it is possible to use an element in which resistance increases as the temperature rises (known as PTC element), performing the same function.

After a short period of continuous operation of the starting circuit, caused by anomalies in the discharge lamp 2, this element considerably increases its ohmic value and accordingly considerably limits the voltage at the diac 15, which no longer supplies trigger pulses to the triac 19.

Finally, all the details may be replaced with other technically equivalent elements.

In practice, the materials employed, so long as they are compatible with the specific use, as well as the dimensions, may be any according to the requirements and the state of the art.

What is claimed is:

1. A device for the lighting and istantaneous hot-relighting of lamps of the discharge type, comprising:

a first transformer having a first and second windings respectively supplied by first and second supply terminals, said second winding being connected to a first electrode of a discharge lamp and acting as a ballast for limiting the current of the lamp, said first and second windings of said first transformer being provided on a bobbin with a plurality of adjoining sections, said bobbin being inserted in a container filled with insulating material;

a first capacitor that is connected to one terminal of said first winding of the first transformer and a second capacitor that is connected between the other terminal of said first winding and said first supply terminal;

trigger means connected to said first winding of the first transformer and supplied by said first and second supply terminals;

discharge control means, connected to said trigger means and between one terminal of the first winding of the first transformer and the first supply terminal;

a second transformer having a first and second windings and series-connected to a second electrode of said discharge lamp, said second transformer acting as a current sensor;

switching means adapted to connect and interrupt the supply of power to said trigger means, said switching means being driven by said second transformer;

said discharge control means producing the discharge of said first and second capacitors on said first winding of the first transformer, said first winding inducing, on said second winding, a high voltage for the hot-lighting of said discharge lamp.

2. A device according to claim 1, wherein said trigger means comprise a variable resistor, a capacitor, and a resistor to which a diac is series-connected.

3. A device according to claim 1, wherein said discharge control means comprise a triac.

4. A device according to claim 3, further comprising a coil series-connected to said triac.

5. A device according to claim 1, wherein said trigger means and said discharge control means comprise a self-starting element.

6. A device according to claim 1, wherein the number of turns of said first winding of said first transformer is smaller than the number of turns of said second winding of the first transformer.

7. A device according to claim 1, wherein said first winding of said second transformer has one terminal connected to the second electrode of said discharge lamp and one terminal connected to said first supply terminal.

8. A device according to claim 1, wherein said switching means comprise a relay the terminals whereof are respectively connected to said second supply terminal and to said trigger means.

9. A device according to claim 8, further comprising delay means connected to the terminals of said second winding of the second transformer, said delay means being adapted to delay the opening switching of said relay.

10. A device according to claim 9, wherein said delay means comprise a diode and a capacitor that are parallel-connected to each other through the second winding of the second transformer.

11. A device according to claim 8, further comprising adjustment means connected between one terminal of said relay and said trigger means.

12. A device according to claim 11, wherein said adjustment means comprise a thermostat, a limiting resistor being series connected to said thermostat.

13. A device according to claim 11, wherein said adjustment means comprise a resistor the value whereof increases with temperature.

* * * * *